United States Patent [19]

Foster

[11] 4,110,875

[45] Sep. 5, 1978

[54] SWAGED NEEDLE

[75] Inventor: Edson Perkins Foster, Cato, Wis.

[73] Assignee: Foster Needle Company, Manitowoc, Wis.

[21] Appl. No.: 799,484

[22] Filed: May 23, 1977

[51] Int. Cl.[2] ..... D04H 18/00

[52] U.S. Cl. ..... 28/115

[58] Field of Search ..... 28/115; 112/222

[56] References Cited

U.S. PATENT DOCUMENTS

| | | | |
|---|---|---|---|
| 3,022,813 | 2/1962 | Glover | 28/115 X |
| 3,727,276 | 4/1973 | Foster | 28/115 |
| 3,792,512 | 2/1974 | Zocher | 28/115 |

FOREIGN PATENT DOCUMENTS

| | | | |
|---|---|---|---|
| 2,038,478 | 2/1972 | Fed. Rep. of Germany | 28/115 |

*Primary Examiner*—Louis K. Rimrodt
*Attorney, Agent, or Firm*—Francis J. Bouda

[57] ABSTRACT

A felting needle, having a body with a crank at one end, a tip at the opposite end, and a blade between crank and tip, the formed end of the blade having a generally "H" shaped cross-sectional configuration to provide opposed longitudinal grooves adjacent the tip, and having a slot in the tip to define two points with the slot aligned with the grooves in the blade portion.

11 Claims, 5 Drawing Figures

Fig. 1
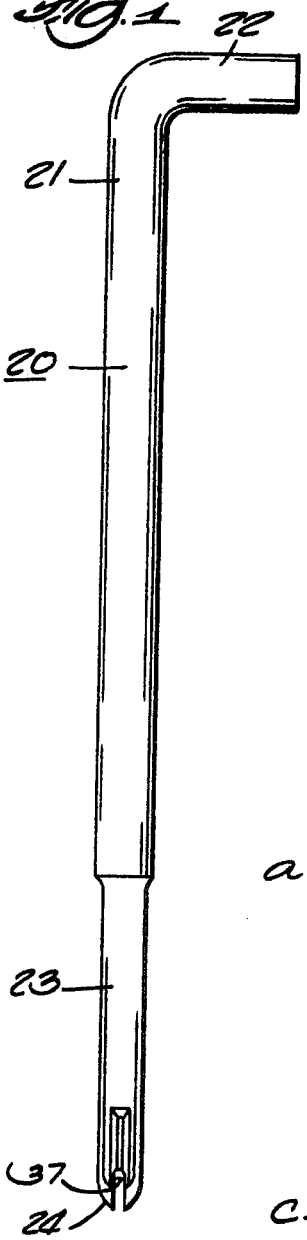
Fig. 3
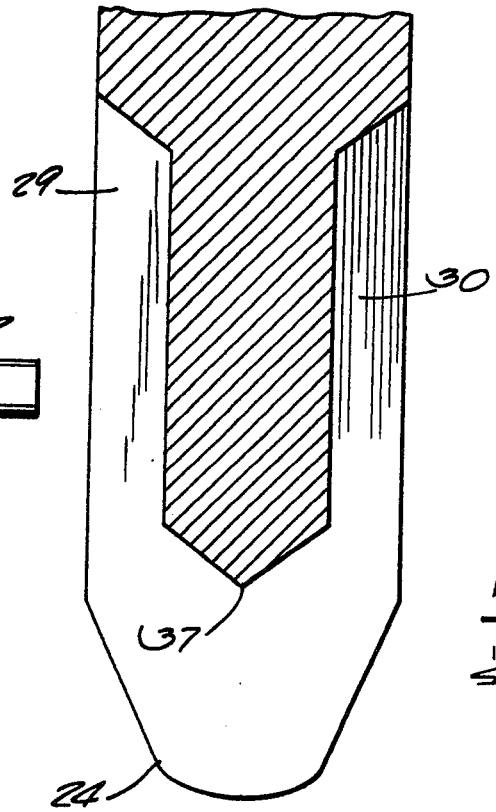
3 → Fig. 2
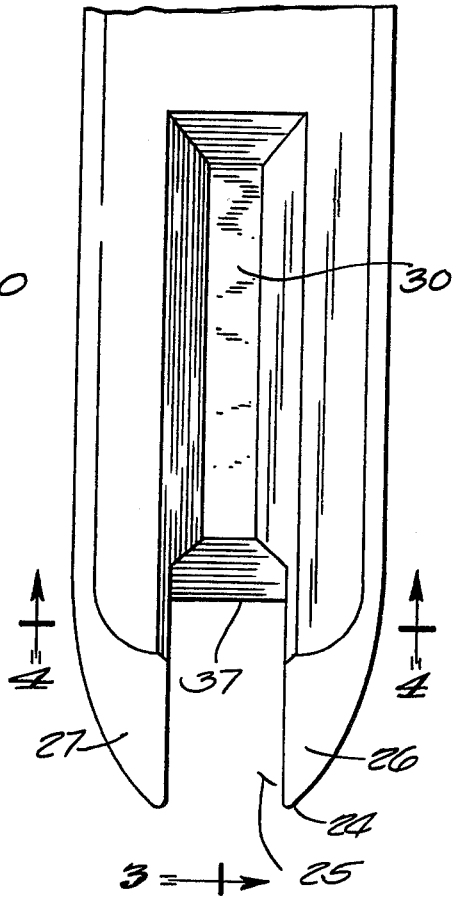
Fig. 4
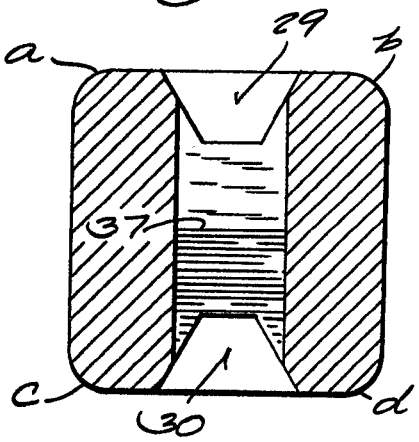
Fig. 5
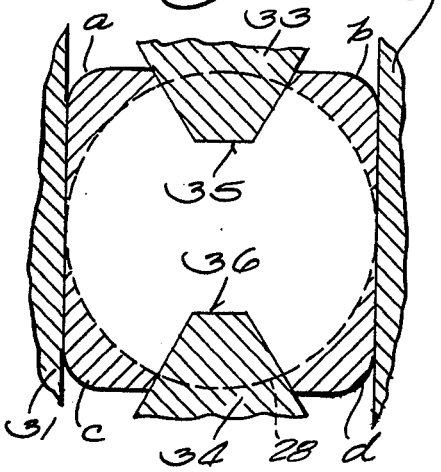

SWAGED NEEDLE

BACKGROUND OF THE INVENTION

Felting needles, having a slotted tip, are not novel, and I draw attention particularly to Glover U.S. Pat. No. 3,022,813, Zocher U.S. Pat. No. 3,792,512, Foster U.S. Pat. No. 3,727,276, and others.

Furthermore, it is not new to use such felting needles to provide a tufted product, wherein the strands of fibers are "looped" out of the base material. However, even small innovations in such felting needles can be critical in the performance of the needle (i.e. efficiency) and also in the effect of such needle has on the end product (i.e., the damage, or lack thereof, on the individual strands of fibers).

In addition, it is important in the operation of the tufted felting process, that the needle be designed so as to work more effectively on the pre-felted mats of material so that the loops which are pushed from the plane of the mats are unitary and compact rather than having fibers shooting off in all directions.

SUMMARY OF THE INVENTION

The forked felting needle of the present invention includes a circular blade having a non-circular blade portion adjacent a tapered forward end and having two points defined by a slot in the forward end. This blade portion may be generally "H" shaped in cross section or, viewed another way, can be substantially square in cross section with indentations on two sides thereof, disposed opposite to each other, to provide a pair of grooves which give a rather "fat" "H" shaped cross section to the blade.

The needle of the present invention can be formed from a strand of wire of the type used in forming felting needles, and I do so by confining the wire between oppositely opposed jaws and bringing against the needle, parallel to the faces of the jaws, a pair of "V" shaped swaging tools which provide a pair of oppositely disposed grooves in the blade to form the needle into a cross section of generally "H" shaped configuration.

Thus one object of the present invention is to provide a tufting felting needle which has improved chances of collecting the fibers.

A further object of the present invention is to provide a needle wherein the loops of the fibers do not shoot off in all directions and are more unitized or combined than in tufted structures of the past.

Another object of the present invention is to provide a pair of oppositely disposed grooves in the needle in which to guide fibers during the tufting operation.

Another object is to provide a tufting felting needle with no exterior sharp points to damage the fibers.

Still an additional object of the present invention is to provide a tufting felting needle with a pair of downwardly- directed, fiber-receiving slots.

With the above and other objects in view, more information and a better understanding of the present invention may be achieved by reference to the following detailed description:

DETAILED DESCRIPTION

For the purpose of illustrating the invention, there is shown on the accompanying drawing a form thereof which is at best preferred although it is to be understood that the various instrumentalities of which the invention consists can be variously arranged and organized, and that the invention is not limited to the precise arrangements and organizations of instrumentalities as herein shown and described.

In the drawings, wherein like reference characters indicate like parts:

FIG. 1 is a side elevational view of a needle embodying the present invention.

FIG. 2 is an enlarged side elevational view of the operative end of the needle of the present invention.

FIG. 3 is a cross-sectional view taken generally along line 3—3 of FIG. 2.

FIG. 4 is a cross-sectional view taken generally along lines 4—4 of FIG. 2.

FIG. 5 is a cross-sectional view of FIG. 2, with parts added

In FIG. 1, the needle 20 has a shank 21 and a crank 22 disposed at right angles thereto, with a circular blade portion 23 having a generally pointed forward end 24.

As is shown in FIG. 2, the pointed end 24 has a fiber engaging slot 25 at the very tip in which to engage the fibers of the batt of material into which the needle is projected during a felting operation. It is clear that the slot 25 is formed between points 26 and 27.

With reference now to FIG. 5, the dotted line 28 indicates the original outline of the circular blade portion 23 whereas the solid lines indicate the finished outline of the needle blade after the grooves 29 and 30 have been formed therein. During swaging, the original circular blade portion 23 (which may have a diameter of 0.032"), is confined between the opposite sidewalls 31 and 32 of a swaging tool. One of these sidewalls may be movable, and the needle placed between, whereafter the movable sidewall is brought into contact to hold the circular blade portion in position. Thereafter, a pair of opposed swaging tool portions 33 and 34 are brought against the wire with the tips 35 and 36 respectively thereof being forced against the wire to create the respective indentations or grooves 29 and 30.

By reference to FIG. 5, it is clear that the material within the circular outline of the wire in contact with the swaging portions 33 and 34 has been pushed sideways beyond the circular outline to form the ridges *a, b, c,* and *d,* and that the material is not removed from the wire by machining or grinding but is compacted into the ridges so as to give additional body and strength to the needle, rather than weakening it. This provides the "H"shaped configuration, keeping the sidewalls of the finished blade preferably no wider than the original diameter of the circular portion 23. This minimizes the damage to the felted batt while yet providing strength to the needle, and additionally forming the grooves 29 and 30 into which the strand or fibers to be tufted are disposed after being caught in the slot 25. It is clear that the strands, when draped over the crest 37, lie in the grooves 29 and 30.

By way of illustrating the dimensions of the needle of the present invention, I have indicated that the external diameter of the original blade may be 0.032". The depth of the grooves 29 and 30 may be 0.006" inwardly from the sidewalls, with the width of each groove at its base being 0.008" and at its upper or outer end 0.020".

I have calculated that the amount of material displaced sidewardly when the swaging tool impinges against the wire will substantially fill the corners of the tool to form the ridges *a, b, c,*and *d* of the "H" shaped cross section, providing a stronger needle without inreasing the width of the blade and without removal of the body of the material itself.

The fiber receiving grooves in the sidewall of the blade provide a better structure to draw the fibers into a loop. This structure improves the odds of collecting the fibers at the tip of the needle and also insures that the fibers do not shoot off in all directions, and provides a more compact structure than in the past.

The grooves 29 and 30 also define the ridges *a, b, c,* and *d* which guide the fibers into the grooves 29 and 30.

It is to be understood that the present invention may be embodied in other specific forms without departing from the spirit or special attributes hereof, and it is, therefore, designed that the present embodiments be considered in all respects as illustrative and not restrictive, reference being made to the appended claims rather than to the foregoing description to indicate the scope of the invention.

Having described my invention, what I claim as new and desire to protect by Letters Patent are the following:

1. A felting needle having a blade portion preferably of circular cross section with a generally pointed forward end, the blade portion adjacent the forward end being generally "H" shaped in cross section and including two opposed faces, each face having a longitudinal groove therein, each groove disposed between a pair of spaced-apart, longitudinally-extending, radially outwardly-protruding ridges, a fiber receiving slot in the forward end of said blade, said slot being disposed in alignment with said opposed longitudinal grooves and defining a pair of points in the forward end.

2. The felting needle of claim 1 wherein the "H" shaped portion of the blade of the needle also has a pair of oppositely disposed flat sidewalls, said sidewalls being generally parallel to each other and at right angles to the grooved faces.

3. The felting needle of claim 1 wherein the slot terminates in a central crest and then slopes outwardly into the grooves.

4. The felting needle of claim 1 wherein all corners of the blade are rounded, smooth, and polished to provide no exterior sharp points with which to damage the fibers.

5. The felting needle of claim 1 wherein the ridges extend radially outwardly beyond the circular envelope of the blade portion.

6. A felting needle having a blade with a generally pointed forward end, the blade portion adjacent the forward end being generally "H" shaped in cross section and including two opposed faces each having a longitudinal groove therein, each groove disposed between a pair of spaced-apart, longitudinally-extending, radially-outwardly-protruding ridges, and a fiber receiving slot at the forward end of said blade, said slot being disposed in alignment with said opposed longitudinal grooves and defining a pair of points in the forward end.

7. The felting needle of claim 6 wherein the forward end of the blade of the needle has a pair of oppositely disposed sidewalls, said sidewalls being generally flat and parallel to each other and at right angles to the grooved faces.

8. The felting needle of claim 6 wherein the slot terminates in a central crest and then slopes outwardly into the grooves.

9. A needle having a blade with a generally pointed forward end, the blade portion adjacent the forward end being generally square in cross-section with two opposed faces each having a longitudinal groove therein, a fiber-receiving slot at the forward end of said blade, said slot being disposed in alignment with said opposed longitudinal grooves and defining a pair of points in the forward end.

10. The needle of claim 9 wherein the width of each groove at its outer edge is approximately 62½% of the maximum width of the face of the blade in which the groove is formed.

11. The needle of claim 9 wherein the slot terminates in a central crest and then slopes outwardly into the grooves.

* * * * *